United States Patent [19]

Masters

[11] 4,077,076

[45] Mar. 7, 1978

[54] ANCHOR LIGHT

[76] Inventor: John L. Masters, R.R. 1, Iron, Minn. 55751

[21] Appl. No.: 681,061

[22] Filed: Apr. 28, 1976

[51] Int. Cl.[2] ..... B63B 21/52

[52] U.S. Cl. ..... 9/8.3 E; 33/126; 116/107; 362/157

[58] Field of Search ..... 9/8 R, 8.3 R, 8.3 E, 9/9, 25; 240/7.5, 6.4 R, 6.4 F, 10.6 SD, 10.66, 58; 33/126; 114/235 WS, 210, 254; 43/43.1; 116/107, 124 B

[56] References Cited

U.S. PATENT DOCUMENTS

| | | | |
|---|---|---|---|
| 1,846,912 | 2/1932 | Sedgley | 33/126 |
| 1,870,520 | 8/1932 | Loehr | 43/43.1 |
| 2,300,795 | 11/1942 | McAllister | 9/8.3 E |
| 2,381,520 | 8/1945 | Saunders | 9/8.3 E |
| 2,569,611 | 10/1951 | Jenkins | 9/25 |
| 2,578,030 | 12/1951 | Ambrose | 9/8.3 E |
| 2,722,019 | 11/1955 | Brock | 9/8.3 E |
| 2,831,450 | 4/1958 | Schiele | 114/210 |
| 3,121,239 | 2/1964 | Cannon, Jr. | 9/9 |
| 3,162,870 | 12/1964 | Laird | 9/8.3 E |
| 3,264,463 | 8/1966 | Bonner, Jr. | 240/6.4 R |
| 3,420,466 | 1/1969 | Sanders | 114/235 WS |

*Primary Examiner*—Trygve M. Blix
*Assistant Examiner*—Sherman D. Basinger
*Attorney, Agent, or Firm*—Thomas A. Lennon

[57] ABSTRACT

A multi-sectioned, multi-purpose, illuminated marking device especially suitable as a water buoy in which the components can be readily assembled in end-to-end relationship to provide a buoyant device which can be readily seen for a considerable distance when located in the water or elsewhere. The assembled sections serve to house a lightbulb, batteries, switch system, and a reflector which, when the switch is turned on, causes the light to be magnified and transmitted through the translucent walls of the housing. The device also includes an anchor attached to a line and reel to permit raising and lowering of the anchor, the line being multicolored to enable it to be used as a depth indicator. The exterior of the assembled sections are provided with reflective means such as tape or paint to reflect light and permit location of the device when the electric light system, is inoperative or malfunctioning. Many of the sections are interchangeable so that a device of varying length may be readily assembled for convenience of transport and permit a broader range of usage.

12 Claims, 13 Drawing Figures

ANCHOR LIGHT

The object of this invention is to provide a relatively simple and inexpensive device which is primarily intended as a marker for use in the water to help locate an object, such as a boat or a person who has encountered a mishap, or to permit precise relocation of a given area, such as a choice fishing spot which the fisherman wants to return to at some later date.

The device is also designed and intended for on-land use, such as by snowmobiles whose snowmobile might break down, requiring the operator to leave the snowmobile in the dark with the expectation of having to return to the snowmobile during some subsequent evening period.

The device is also suitable for use as a portable source of light or illumination where the need for such use occurs.

Still another object is to provide an illuminated self-powered cordless marker which is usable on land or water, both day and night, and which could be used as flares and flashers are now used to identify stalled cars, road hazards, etc., and which can be carried in the trunk of a car, or on a boat, or truck, or airplane, to be used in the event that an emergency arises.

These and other uses, objects, and advantages, will be readily apparent from a review of the attached drawings and a reading of the following description which relates to said drawings and in which drawings.

Figure 1:
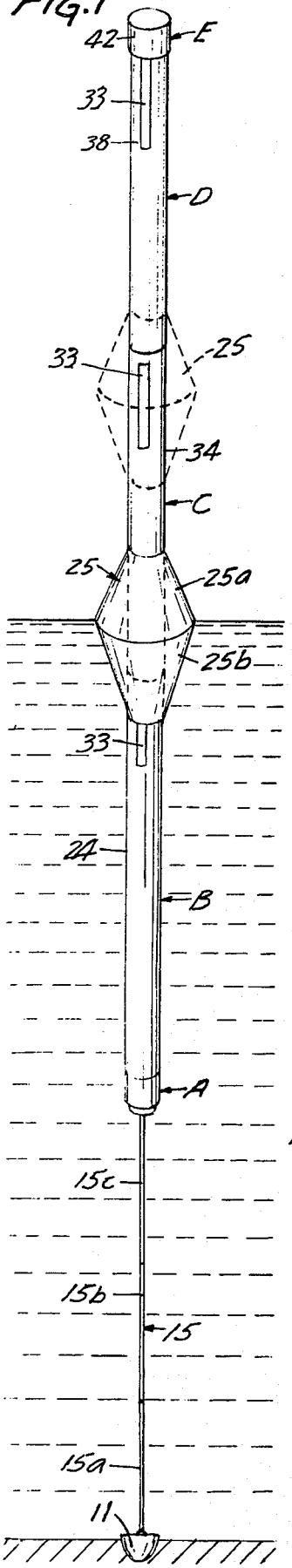
FIG. 1 is a perspective illustrative view of one preferred form of this invention anchored and afloat in a body of water.
Figure 3:
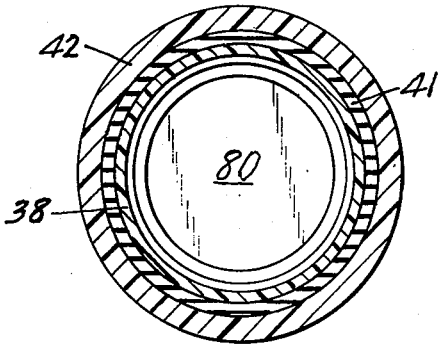
FIG. 3 is a cross-sectional view taken along the line 3—3 of FIG. 2.
Figure 4:
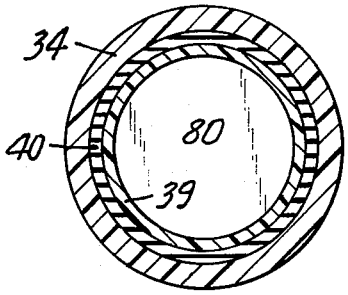
FIG. 4 is a cross-sectional view taken along the line 4—4 of FIG. 2.
Figure 6:
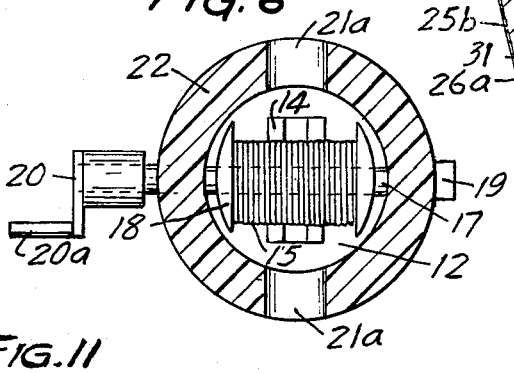
FIG. 6 is a cross-sectional view taken along the line 6—6 of FIG. 2.
Figure 2:
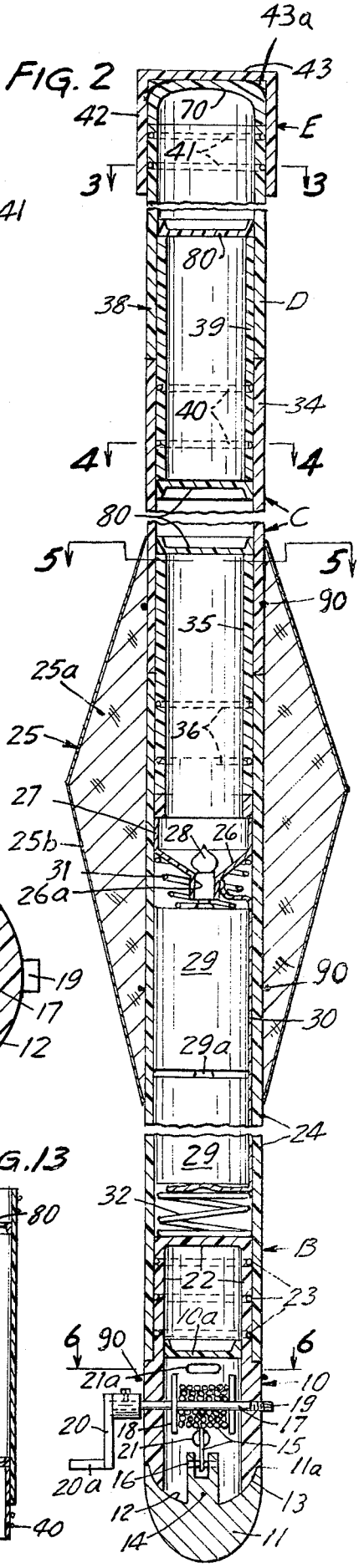
FIG. 2 is a vertical, sectional view through the longitudinal center line of the device of FIG. 1 on an enlarged scale.
Figure 11:
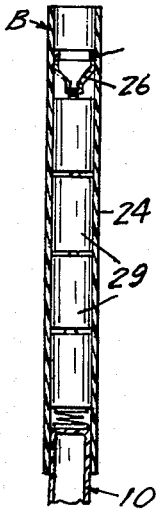
FIGS. 11 – 13 are vertical sectional views of part B, C and D respectively of FIG. 1 on a reduced scale.
Figure 12:
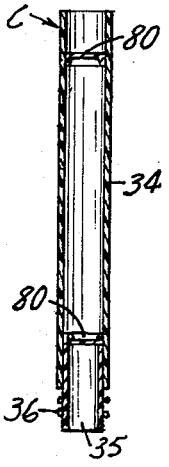
Figure 13:
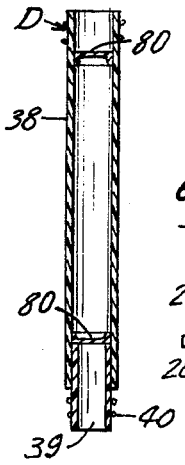
Figure 5:
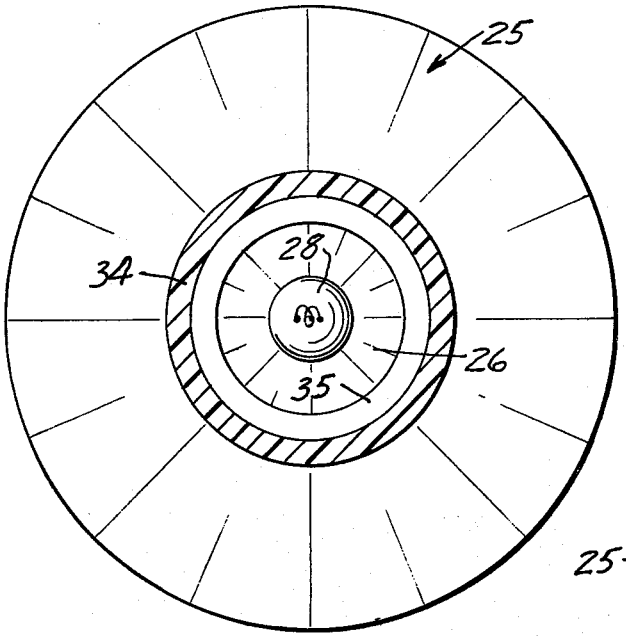
FIG. 5 is a cross-sectional view taken along the line 5—5 of FIG. 2.

The invention, in broad terms, includes with respect to the complete assembly shown in FIGS. 1 and 2, means for maintaining the device substantially upright in the water; means for preventing movement of the device when in the water from a particular location; means providing a source of light; means for making the light visible for a considerable distance; means for presenting the light to the viewer in a manner which signals a special meaning such as a distress signal, or a safety marker; reflective means for making the device more visible when the light isn't operative; and depth indicating means.

Referring now to the drawings, the device, as shown, comprises five separate components respectively identified in their entireties by the letters A–E inclusively, A being the anchor section, B being the light source, C being an intermediate illuminating section, D being another intermediate illuminating section, and E being an illuminating top cap section.

The anchor section A includes a tubular shell 10, which is cylindrical in form and circular in cross-section and is preferably formed of a plastic material. The lower end of the cylinder is enclosed by an anchor 11, which is generally semi-conically tapered in form and preferably formed of lead, although the invention is not restricted to either the particular design of the anchor itself or the material from which it is made.

Suffice it to say that it is sufficiently heavy to sink rapidly in water and maintain the marker in its entirety substantially upright in the water, and to hold it against movement when lowered to an anchoring position on the bottom of the body of water in which the marker is floating.

The anchor is preferably provided with a concave interior face 12 which mates with an annular correspondingly shaped lower shoulder 13 comprising the lower end or extremity of the cylinder 10. The anchor has an upwardly extending shank portion 14 to which is connected a flexible line 15 (of suitable material such as nylon) by means of an anchoring pin 16.

The line 15 is preferably so formed that it can also function as a tape measure or depth indicator for determining the depth of the water at any given spot. One preferred form of line is one in which the line is multicolored and changes color at certain specified intervals. Thus, (part 15*a*), the first 20 feet of the line, might be red, the next 20 feet (part 15*b*), yellow, the next 20 feet (part 15*c*) blue, the next 20 feet (not shown), white, and the final 20 feet (also not shown), clear.

Thus, the user can quickly tell from the color showing above the water line how deep the water is. The line can, of course, be divided into longer or shorter increments if desired, depending on the degree of accuracy desired when using the line 15 as a measuring device. The line 15 is wound about an arbor or spindle 17 forming part of a reel 18, said reel being supported by the walls of the cylinder 10 by means of the outer ends of the arbor 17 extending through suitable openings in the cylinder wall, with one end of the spindle being secured by a nut 19, and on the opposite end by a crank arm 20, which not only holds the reel in position but also serves as means of winding and unwinding the line 15 and thereby raising and lowering the anchor 11. The nut 19 also functions as a lock mechanism to prevent unwinding when the anchor is raised, the locking effect being accomplished by simply tightening the nut 19 sufficiently to have it bear against the outer face of tube 10 with enough frictional engagement to prevent the spindle and reel from turning. Conversely, loosening the nut 19 without actually removing it, enables the reel to turn and the anchor to fall. The anchor 11 is heavy enough to function as a form of ballast or weight to help stabilize the upright position of the device and maintain it in a substantially upright readily viewable position when it is afloat in the water.

It will be noted that the wall surfaces 11 and 12 of the anchor meet in a relatively sharp edge 11*a*, which can bite or claw into the ground on the bottom of the body of water or hook obstacles such as stones or vegetation to deter or prevent the floating marker from drifting or working its way away from its intended location.

The walls of the cylinder 10 are provided with a plurality of openings or ports 21 and 21*a*, which, in the form shown, consist of a series of four openings 21 spaced 90° apart on a common level, and a series of four openings 21*a* on another common level, thereby providing four ports at two different levels for a total of eight ports, so as to permit drainage of the water from the interior of the cylinder 10 when not afloat in the water, and to permit water to enter the cylinder and provide additional weight or ballast when in the water.

It will also be noted that the drainholes or waterports 21*a* are elongate oval shaped openings which are intentionally shaped in that manner and located as it is in an area immediately above and close to the reel or spool 18 so that a small hook or other object may be inserted through the openings 21*a* to give access to the line or string wound about the spool in the event that the line becomes tangled or for any other reason needs treatment after the entire section A has been put together.

It will also be noted that a plug 10*a* is inserted in the cylinder 10 in spaced relationship from the top 22 thereof so as to provide a hermetically sealed area in the anchor portion so that if the device is disassembled or the anchor section becomes disengaged from the remainder of the marker, that it will be able to conveniently float on the surface and not be permanently lost.

It will also be noted that the crank handle 20 is provided with a weight 2*a* so that the handle can function as a counterweight to prevent the line from unwinding when the anchor 11 hits the bottom of the body of water. It will be appreciated that if there is no counterweight or lock or some other means of stopping the unwinding of the line, the entire device will tend to wander from the location intended to be marked as long as there is any line left on the spool with the movement of the device being caused by wind, waves or the tide. Thus, the counterweight must be of such design and weight that it will permit the anchor 11 to quickly fall by gravity to the bottom without interference, and must also be of such nature that it will tend to hold the anchor in the raised position illustrated in the drawings and yet be able to discourage wandering of the marking device once it is suitably anchored.

The top of the cylinder 10 is enclosed by a top wall or roof 22. The exterior of the shell 10 is provided with sealing means in the form of a plurality of resilient "O" rings serving to engage and hold the next adjacent section in a manner herein after described.

These "O" rings, which in the form shown are three in number, are seated in suitable annular grooves formed in the exterior wall of shell 10, and serve to provide a water tight seal between section A and the next adjacent section B, and also serve as a resilient frictional engagement between the two sections A and B to help hold them together until they are manually pulled apart.

The anchor 11 is lowered by loosening the nut 19, whereby the anchor will normally automatically fall or lower itself by gravity, with the crank handle 20 being available for lowering the anchor if gravity alone does not suffice. To raise the anchor, the crank handle 20 must be turned to rewind the nylon line on the spool and raise the anchor.

Consideration is next directed to section B, which connects, at its lower end, with section A and is designed to provide the source of light. Section B includes another cylinderical tubular shell or sleeve 24 of circular cross-section. Mounted on the exterior of the tube 24 is a float 25, which is manually slidable on the tube 24, and the other shells or tubes of corresponding sizes belonging to other sections, and yet it engages the tube 24 and said other tubes with a sufficient frictional force to enable the float to retain and maintain its position on the tube once it has been put in its desired location. The float 25 is preferably slidable on the tube to enable it to also function as a ballasting means which can be conveniently adjusted upwards or downwards to meet the particular needs and to, again, help to maintain the entire device in a substantially upright position when afloat in the water.

To add additional buoyancy and to prevent sinking of the device in the event a leak develops, the float 25 is preferably formed of some type of buoyant foam plastic material 25*a* and is preferably enclosed by a water tight plastic shell 25*b* which in it of itself creates a sealed buoyant interior. The float 25 is freely slidable on the full length of tubes 24, 34, and 38 so that the proper balance can be maintained for the device when it is afloat in the water, and can be completely removed for use on land, if so desired.

Cylinder 24 is also preferably made of light transmitting translucent or transparent plastic material, preferably yellow in color. Near the upper end of the cylinder 24, a reflector 26 is mounted interiorly of the cylinder and is held in place against movement in an upward direction by a lock ring 27, which is secured to the interior wall of tube 24 by any suitable means, such as an adhesive. The reflector is concavely conically tapered and provided with a shiny, highly reflective outer surface to collect and reflect light from the light bulb used in conjunction therewith outwardly or upwardly. The reflector 26 supports light bulb 28, which bulb is removably installed in a central opening or socket 26*a* in the relector and draws its power from a plurality of cylindrical dry cell batteries 29, which, in the illustrated version, are four in number, but which can be greater or less than that number within the scope of the invention.

The batteries 29 are arranged in end-to-end relationship, each having a knob 29*a* at one end, engaging a metallic bottom 29*b* of the immediately adjacent battery, to provide the necessary serial contact between adjacent batteries.

The batteries are preferably installed within a metallic strap 30, which is useful in installing and removing the batteries as a unit and also provides the required electrical connection between the batteries and the light bulb. The strap is "C" shaped and encloses all the batteries between the two arms thereof. A helically coiled spring 31 is interposed between the reflector and the top most battery and is designed to normally bias or push the batteries out of contact with the light bulb to deactivate same. Another helically coiled spring 32 is provided at the lower end of the series of batteries and is in contact with the lower most battery in the series and helps to retain the batteries in the desired position. However, spring 31 is stronger than spring 32 so that the bulb 28 is still deactivated unless the tension of spring 31 is overcome by an upward force greater than that capable of being exerted by spring 32 by itself. It will also be understood that the invention is not limited to the helically coiled spring means illustrated, and other suitable spring means, such as a resilient plastic foam, may be substituted for the metallic coiled spring shown.

When sections A and B are connected by insertion of the tube 10 into the lower end of the tube 24, the top wall 22 of section A pushes against spring 32 and forces the strap and batteries upwardly sufficiently to enable the knob 29*a* of the top most battery to make an electrical connection with the light bulb 28 and cause it to go on. When it is desired to turn the bulb off, section A is pulled slightly away from the section B (without actually becoming disengaged therefrom), a small incremental distance sufficient to permit the top battery to again electrically disengage from the light bulb and permit it to be turned off. Thus, section A, in combination with the springs 31 and 32, function as a form of switch means or mechanism which is convenient and easy to use and eliminates the use of a conventional metallic switch, thereby not only helping to reduce the cost of the device, but also providing a switch mechanism which will not rust and quickly malfuntion as a conventional slide or push-bottom type of switch might.

The interior wall of the lower end of the cylinder 24 is engaged by the series of "O" rings 23 carried by section A which prevent water from entering the cylinder 24, thereby sealing the interior of cylinder 24 from water and preventing rusting of the contents thereof.

Section C involves a cylindrical plastic tube 34 of circular cross-section which is provided, at its lower end, with a connecting tube 35, also preferably formed of plastic. This tube 35 has an exterior diameter which corresponds to the interior diameter of the cylinder 34 and is permanently secured to the inner wall of cylinder 34 by any suitable means, such as an adhesive, which forms a water tight seal with tube 34. The exterior of the tube 35 is provided with a plurality of resilient "O" rings 36 which are seated in annular grooves formed in the outer wall of tube 35 and are intended to engage the interior wall of the cylinder 24 when section B and C are connected in end-to-end relationship, the connecting tube 35, being insertable into the upper open end of tube 24, with the "O" rings 36 sealing the connection and preventing the entrance of water into the interior of the tubes, and also helping to frictionally hold said sections together until manually pulled part. The cylinder 34 is preferably of light transmitting translucent or transparent material and also preferably yellow in color so that the light from bulb 28 will emit a bright yellow light in the darkness. The cylinder 34 is also preferably provided exteriorly with reflective means such as a plurality of strips 33 or reflective tape (preferably red in color) on the exterior thereof to provide contrasting red and yellow surfaces to alert searchers when the light from their flashlights, etc., falls on the marker when the lightbulb is not functioning.

Attention is next directed to section D which is similar in many respects to section C and includes a plastic tube or cylinder 38 of circular cross-section which is provided, at its lower end, with a connecting tube 39, which is preferably of plastic material and which is identical to connecting tube 35 of section C and which is also secured to the inner wall of the cylinder 38 by adhesive or other suitable means to provide a water tight connection and prevent entrance of water between tubes 38 and 39. The tube 39 designed to be inserted into the upper open end of tube 34 and is provided with a plurality of "O" rings 40 which are seated in annular grooves formed in the exterior wall of tube 39 and sealingly engage the interior wall of tube 34, again providing a water tight seal to prevent water from entering the interior of the device, and to help to frictionally hold sections C and D together until manually pulled apart. The exterior wall of the upper end of cylinder 38 is also provided with a pair of "O" rings 41, which are seated in annular grooves formed in the exterior wall of cylinder 38 and to help seal the upper end of tube 38 in a manner hereinafter described. Tube 38 is also preferably formed of light transmitting transparent or translucent material and of yellow reflective material.

Sections C and D are each preferably provided with sealing and supporting elements 80 which are identical and disposed at opposite ends of each of the respective sections. These elements are preferably formed of clear plastic material and are secured to the exterior walls of their respective sections by any suitable means such as glueing. These sections serve as means for providing an airtight interior for each of the sections C and D so that they are also capable of individually floating in the event that the device becomes disassembled and the components thereof become separated. The elements are clear or transparent so that the light will pass there through with a minimum of reduction of intensity.

Attention is next directed to the upper most cap section E which comprises a plastic cylinder 42 which is closed at its upper end 43. The cap fits over the upper end of section 38 and sealingly engages the "O" rings 41, which also serve to frictionally hold the cap on the tube until manually pulled apart. This cap is also of light transmitting transparent or translucent plastic material which is preferably red in color.

It will be noted that the top E is provided with a reflector 70 which provides a concave reflective surface for the light projected outwardly by the light bulb 28 so as to increase and concentrate the intensity of the light ultimately transmitted through the walls of sections C and D. The reflector 70 maybe formed of any suitable material which will provide the desired reflective surface.

Figure 9:
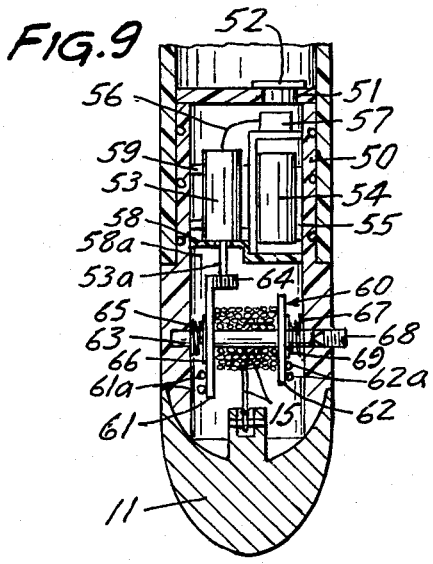
FIG. 9 is a partial vertical section of an alternate form of the invention involving a powered anchor.
Figure 10:
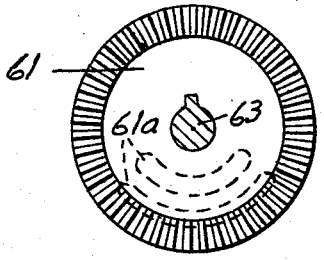
FIG. 10 is end view of the anchor reel of FIG. 9, with portion of FIG. 9 broken away and in section.

An alternate form of anchoring section is shown in FIG. 9 in which a motorized version is illustrated, which version has the advantage that it is more convenient and efficient to operate than the manual version previously described. The anchor 11 abutts against and is broadly supported by the cylindrical supporting structure 50 which is generally similar to cylindrical structure 10 of the previously described anchor section. Disposed above the section 10*b* is a sealed unit 50 which can be formed of any suitable material such as plastic. The top opening or cover of the sealed unit 50 is provided with a top opening 51 which is closed by a removable rubber plug 52. When the plug is installed, the unit 50 is hermetically sealed so that water can not enter so as to protect the contents of the interior chamber of the unit 50.

Within the unit 50 is a small electric motor 53 and a dry cell battery 54 supported and enclosed by a battery case 55, the motor and battery being interconnected by suitable wiring 56 with a push button switch 57 being connected to the wiring for stopping and starting the motor. The motor is supported on an indented portion 58 which separates it from the chamber housing the reel. The motor is further supported by means of a pair of fastening devices 59 which extend between the motor and the wall of the cylinder to anchor the motor against movement. Disposed in the chamber defined by the anchor supporting structure 10*b* in another form of spool or reel 60 which has two spaced apart circular disks 61 and 62 which are secured to the reel spindle 63 in spaced apart relationship there on and serves to confine there between the line 15. Each of these disks is provided with a weight 61*a* and 62*a* respectively, which weights serve as counterweights in this version to accomplish the same purpose as the counterweighted handle iof the manual version previously described. One of the disks 61 is larger than the other disk 62 and extends upwardly into the recess 58*a* formed by the closure plate 58 with said disk 61 functioning as a driven gear for the reel. A drive gear 64 is located in the recess 58*a* and is supported and driven by a drive shaft 53*a* driven by the motor 53. The gear 64 engages the face of the disk or driving gear 61 so as to cause the spindle to turn and wind up the line and retract the anchor. In this version the anchor is allowed to drop by gravity and is raised by the motor. It can be appreciated that this motorized version is substantially more convenient to operate with respect to raising the anchor and winding the line on the spool.

The disk 61 is held against, and in engagement with, the gear 64 by means of a spring 65 which bears against the inner wall of the structure 10*b* at one end and at the other end bears against a washer 66 which in turn is in engagement with one face of the disk 61. Another spring 67 is provided on the opposite side of the spindle to maintain the reel in spaced relationship with the supporting structure and provide a yielding resistance against which the entire reel structure operates. A lock or release pin 68 is pointed inwardly and bears against the spring 67 which in turn bears against another washer 69 interposed between the spring and the smaller disk 62 and causes the reel to move out of engagement with the drive gear 64. The combination of the tension of the spring 67 and the manual pressure applied to the pin 68 serving to overcome the resistance of the heavier spring 65, it being recognized that spring 65 is a stronger spring than spring 67 so that when the spring 67 does not have the benefit of the assistance of a lock pin 68, that the spring 65 will overpower the spring 67 and serve to shift or move the reel back into engagement with the gear 64, which movement is precisely what occurs when the pin 68 is pulled outwardly.

Thus, when the parts are assembled and placed in the water as shown in FIG. 1, the sealed interior of the assembled sections provides a buoyant structure which will float on the water.

If the operator has time and the ability to turn the switching mechanism on, the marker can be floated in the water in an illuminated fashion for a long period of time and can be retained in the precise location by a lowering of the anchor.

Should the operator encounter a mishap, the device will float in and of itself on the surface of the water and, although not illuminated by the bulb, will still aid searchers because of the reflective nature of the exterior surface and the bright easy-to-see colors which are of the color and intensity commonly used everywhere on warning or safety signals and devices.

If the device is to be used to simply mark a particular location to be returned to the next day or some later time, it can be made to float and anchored without turning on the light switch, and its ability to extend a considerable distance above the water along with its bright coloration enables it to be quickly and readily located, even during the daytime.

Figure 7:
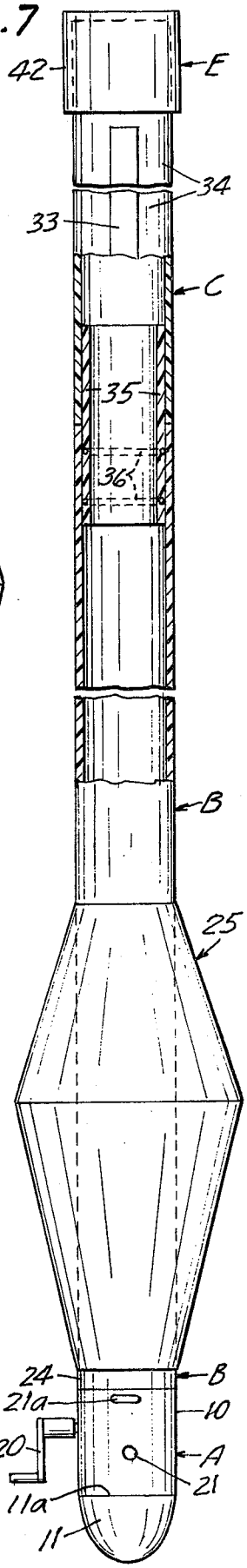
FIG. 7 is a side elevational view of another form of the device with one of the sections shown in FIGS. 1 and 2 removed; and a portion broken away.
Figure 8:
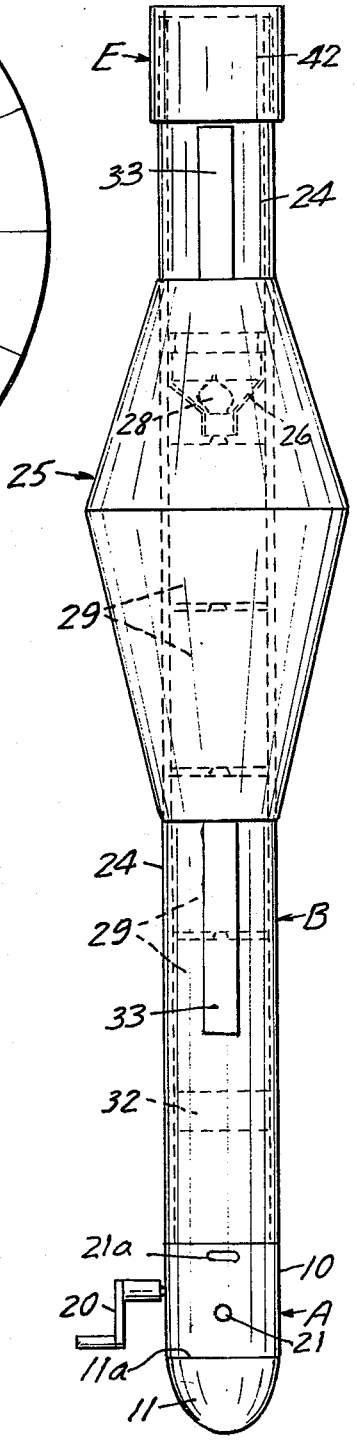
FIG. 8 is a side elevational view of still another form of the device with two of the sections shown in FIGS. 1 and 2 removed.

The former comments regarding the use of this device in water are also applicable to its use on land, except that it is apparent that the buoyant features therein become unimportant, as well as the ability to anchor the device in the water. If the device is to be used as a lantern, then either or both of the tubular sections C and D can be disconnected so that a device which is easier to carry and handle consisting of sections A and B with a cap E can be used as shown in FIG. 8, the only real reason for dispensing with the sections C and D being to make the device more convenient to carry, handle, and operate. Where desirable, still another combination of sections can be used, such as section A, B, C and E, as shown in FIG. 7, by simply eliminating section D. It will thus be apparent that the device of this invention is a multi-purpose, multi-sectional, buoyant, illuminatable marker of qualities not heretofor available in any marker or buoy used in the water. The additional use of the device as a buoy is also important, since one or more of these units can be used as a conventional buoy to make the traveling limits or lanes of water traffic and can even be used to define a beach area if so desired. It will also be recognized that the device of this invention can be used as a market or a buoy with the batteries and/or light bulb removed therefrom or if such are unavailable at the time a marking device is needed.

It will be appreciated that the device herein disclosed has a variety of uses, many of which have perhaps not yet been recognized. One additional use not previously mentioned is its use by the railroads as a replacement for the railroad flares presently used and can also be used by the conductors, brakemen and other personnel to signal to each other during operation of the train, this device providing a much more viewable signal than is presently capable of being provided by the normal flashlight. With respect to this device's use in a manner comparable to a conventional flashlight, it will be appreciated that the cap section E must be removed to enable it to so function when a narrow intense light beam is desired, particularly if the cap is provided with a reflector 70 which would obviously prevent any light from being transmitted longitudinally outwardly of the device.

It will, of course, be understood that various changes may be made in the various parts and dimensions referred to and illustrated herein, without departing from the scope of this invention.

It will also be understood that the sections A – E inclusive are interchangeable with other sections to permit many combinations therof. Thus, the reduced upper end portion 10 of anchor section A is selectively frictionally insertable into and combinable with any of sections B, C, or D. Section B can selectively mate with any of sections C, D and E in addition to Section A. Section C can selectively mate with A, B, D and E. Section D can selectively mate with A, B, D and E, and section E can selectively fit on any of sections B, C, and D. All the sections telescopically engage the sections they are capable of mating with, and all sections except section E are individually buoyant so they can individually float in the water and not get lost or sink to the bottom when they become separated from their companion sections.

Even though the plugs or partitions 80 in sections D and E hermetically seal the interior of their sections, light is freely passable there through so that they do not interfere with the free passage of light through their respective sections longitudinally from one end to the other, and completely through each end thereof.

The tapered design of the float 25, particularly of the lower half thereof, has proved particularly effective in maintaining the device in a substantially upright position in the water and preventing the device from tipping over on its side. The free adjustability of the float longitudinally of the various sections also contributes to being able to locate the float in the most effective place longitudinally of the device in so far as maintaining proper balance and an upright position is concerned.

Each of the exterior cylinders 24, 34 and 38 are of light transmitting character so that light from the bulb 28 may be transmitted through said walls laterally of the device, so that it can be readily seen a substantial distance in any direction laterally of the device. Thus, the walls of said cylinders may be translucent or transparent in character. The cap E normally collects and reflects the light backward into the sections C and D to intensify the light transmitted laterally through their walls. However, if the device is to be used to direct light in a given direction in the manner of a flashlight, then the cap E must be removed to enable the light to be projected longitudinally of whichever section B C, or D provides the terminal end of the device through which the light is to be directed. The cap E has a reflective exterior surface, preferably red to facilitate finding the device when the bulb 28 is not operating.

All of the sections A through E, and float 25, and especially sections C, D and E, preferably have completely light reflective exterior surfaces, and this is preferably accomplished by forming these sections of plastic material which is inherently light reflective, so as to provide or expose as much light reflective surface as possible to pick up the light of persons seeking the device or searching in the area to lead them to the device.

Another color combination which has proved particularly effective is one in which the cap E is a reflective red, sections C and D are a reflective greenish yellow, and sections A and B are a reflective yellow with red reflective bands.

Another preferred alternative form is to provide O-rings 90 on the exterior walls of the various sections A, B, C and D, for engagement with the float 25 to provide additional sealing, and thereby help keep the interior of the device sealed, dry and buoyant, for these external O-rings are located so as to seal the seams at the point of connection of the various sections.

It should also be noted that cap E is buoyant and capable of floating because of a dead air space 43*a* provided between the cap walls 42 and 43 and the reflector 70.

The embodiments of the invention in which an exclusive property or privilege is claimed are defined as follows:

1. A device comprising;
a buoyant housing,
a light bulb supported by said housing,
and means supported by said housing for turning said light on and off,
said housing comprising a plurality of tubular sections having disconnectible telescopically engageable portions for connecting said sections in end to end relationship,
said housing including an anchor section comprising one end of said device and supporting an anchor, said light bulb, and battery means housed in said tubular sections for illuminating at least a portion of the interior of said housing,
at least a portion of the housing defining the illuminated portion of said housing being capable of transmitting said light generally laterally of said device when said device is afloat,
a float mounted on the outside of said housing and slidable relative to the longitudinal axis of said tubular sections,
said float being adapted to maintain said device in a generally upright position when afloat.

2. The device of claim 1, wherein said battery means and light bulb are capable of movement relative to one another for energizing and deenergizing said bulb,
said housing including two sections movable relative to one another in such manner that relative movement of said sections in one direction effects energizing relative movement between said battery means and bulb, and relative movement of said sections in the opposite direction effects deenergizing relative movement of said bulb and battery means.

3. A device comprising;
a buoyant housing,
a light source supported by said housing,
and means supported by said housing for turning said light on and off,
said housing comprising tubular structure including at least two separable telescopically engaged tubular sections,
said light source being housed within said tubular structure and adapted to direct light in one direction longitudinally thereof,
reflector means for intercepting said light and reflecting it back in the opposite direction,
said tubular structure having a wall portion between said light source and reflector means through which said light is transmitted
an anchor supported by said housing,
means for raising and lowering said anchor,
a float slidably mounted exteriorly of said tubular structure,
and battery means housed within said tubular structure for energizing said light source.

4. A device comprising;
a buoyant housing,
a light source supported by said housing,
and means supported by said housing for turning said light on and off
having wall structure defining an anchor chamber,
a reel rotatably mounted in said chamber,
a line wound around said reel,
said line interconnecting said reel and anchor, and an opening in said wall structure adjacent said reel providing access to the line wound thereon for untangling said line,
said opening being disposed opposite said reel and spanning more than half of the length of said reel.

5. A device comprising comprising;
a buoyant housing,
a light source supported by said housing,
and means supported by said housing for turning said light on and off
having wall structure defining an anchor chamber,
a reel rotatably mounted in said chamber,
a line wound around said reel,
said line interconnecting said reel and anchor,
and at least two openings in said wall structure adjacent said reel providing access to the line wound thereon for untangling said line,
said openings being disposed on opposite sides of said reel.

6. A device comprising;
a buoyant housing, a light source supported by said housing,
and means supported by said housing for turning said light on and off
having wall structure defining an anchor chamber,
a reel rotatably mounted in said chamber,
a line wound around said reel,
said line interconnecting said reel and anchor,
and at least four openings in said wall structure adjacent said reel providing access to the line wound thereon for untangling said line,
said openings being disposed substantially ninety degrees apart from each other.

7. A device comprising
a buoyant housing,
a light source supported by said housing,
and means supported by said housing for turning said light on and off
said light source directing light in a direction longitudinally of said housing,
said housing including a tubular portion of substantial length extending beyond said light source in said direction and receiving said light interiorly thereof,
substantially all of said tubular portion being formed of light transmitting material whereby substantially all of the exterior of said tubular portion exposed to view is illuminated by said light,
and wherein said tubular portion is detachably secured to the housing supporting said light source,
and wherein said tubular portion includes a pair of transparent discs mounted interiorly thereof in spaced relation longitudinally of said portion and hermetically sealed with respect to said tubular portion providing a sealed chamber making said tubular portion buoyant.

8. A device comprising;
a buoyant housing,
a light source supported by said housing,
and means supported by said housing for turning said light on and off
said light source directing light in a direction longitudinally of said housing,
said housing including a tubular portion of substantial length extending beyond said light source in said direction and receiving said light interiorly thereof,
substantially all of said tubular portion being formed of light transmitting material whereby substantially all of the exterior of said tubular portion exposed to view is illuminated by said light,
and wherein said tubular portion is detachably secured to the housing supporting said light source,
and wherein said tubular portion includes at least two sections, each of said sections including a pair of transparent discs mounted interiorly thereof in spaced relation longitudinally of their respective sections,
said discs being hermetically sealed with respect to the wall portions of their sections and providing a sealed chamber in their respective sections making their respective sections independently buoyant.

9. The device of claim 8, wherein said sections are connected in telescopic relationship and held against relative movement by friction.

10. A device comprising;
a buoyant housing,
a light source supported by said housing,
and means supported by said housing for turning said light on and off
said housing including a plurality of tubular portions,
the wall structure of each tubular portion comprising at least a portion of the exterior wall structure of said device,
and spaced members in each tubular portion forming with the wall structure of said tubular portion a sealed chamber to contribute to the buoyancy of said housing.

11. A device comprising;
a buoyant housing,
a light source supported by said housing,
and means supported by said housing for turning said light off and off,
said housing including a tubular portion, and
transparent discs installed in said tubular portion in spaced relationship with each other defining with said tubular portion a sealed chamber which contributes to the buoyancy of said housing,
said sealed chamber receiving light from said light source through at least one of said transparent discs and transmitting said light through the exterior wall of said tubular portion.

12. A device comprising;
a buoyant housing,
a light source supported by said housing,
and means supported by said housing for turning said light on and off
and including an anchor and a reel,
line wound on said reel and connected with said anchor for raising and lowering same,
an electric motor and battery for powering same, both of which are supported by said housing,
said reel including a driven gear drivingly connected therewith,
and a second gear driven by said motor and drivingly engaged with said driven gear on the reel for turning said reel in an anchor raising direction,
and wherein said reel is selectively shiftable between two positions,
said reel when in one position having said driven gear in operative engagement with said second gear,
said reel when in said second position having said driven gear out of operative engagement with said second gear.

* * * * *

UNITED STATES PATENT OFFICE

CERTIFICATE OF CORRECTION

Patent No. 4,077,076 Dated March 7, 1978

Inventor(s) John L. Masters

It is certified that error appears in the above-identified patent and that said Letters Patent are hereby corrected as shown below:

Column 3, line 49, between the words "rings" and "serving" -- 23, the "O" rings -- should be inserted.

Column 4, line 42, between the words "in" and "end" -- series in -- should be inserted.

Claim 11, line 25, "off" first occurrence should read -- on --.

Signed and Sealed this

*Twenty-seventh* Day of *March 1979*

[SEAL]

*Attest:*

RUTH C. MASON
*Attesting Officer*

DONALD W. BANNER
*Commissioner of Patents and Trademarks*